United States Patent [19]

Kelly

[11] 4,162,597

[45] Jul. 31, 1979

[54] INSULATION BLOCK AND MOUNTING MEANS THEREFOR

[76] Inventor: Thomas L. Kelly, 50 Randolph Ave., Waterbury, Conn. 06710

[21] Appl. No.: 792,784

[22] Filed: May 2, 1977

[51] Int. Cl.[2] ..... E04B 5/00

[52] U.S. Cl. ..... 52/410; 52/592; 52/748

[58] Field of Search ..... 52/592, 589, 590, 591, 52/408–412, 574, 748, 747, 515

[56] References Cited

U.S. PATENT DOCUMENTS

| | | | |
|---|---|---|---|
| 621,100 | 3/1899 | Knowles | 52/590 |
| 2,176,778 | 10/1939 | Terrell | 52/592 |
| 3,121,649 | 3/1964 | Oliver | 52/409 |
| 3,122,073 | 2/1964 | Masse | 52/515 |
| 3,613,327 | 10/1971 | Hall | 52/592 |
| 3,878,658 | 4/1975 | Davis | 52/410 |
| 3,914,916 | 10/1975 | Simpson | 52/748 |
| 3,918,233 | 11/1975 | Simpson | 52/747 |
| 4,051,641 | 10/1977 | Elliott | 52/592 |

FOREIGN PATENT DOCUMENTS

| | | | |
|---|---|---|---|
| 664960 | 1/1952 | United Kingdom | 52/589 |
| 717032 | 10/1954 | United Kingdom | 52/592 |
| 886616 | 1/1962 | United Kingdom | 52/410 |

*Primary Examiner*—Price C. Faw, Jr.
*Assistant Examiner*—H. E. Raduazo
*Attorney, Agent, or Firm*—Peck & Peck

[57] ABSTRACT

A roof, or the like, composed of a plurality of blocks of relatively rigid insulating material which may be formed of Styrofoam. The relatively rigid blocks of insulating material being so configured that adjacent blocks will mate together forming a sealing means for the roof, or the like, which constitutes, in effect, a hermetic seal to thereby eliminate the possibility of temperature, moisture, etc. from entering between the blocks. The concept also involves the method of laying the plurality of blocks, whereby the sealing between adjacent blocks is aided by what I shall term an "UP" and "DOWN" arrangement of alternate blocks. The medium, which is rigid insulation, is intended to be used to form the insulating blocks will not accept adhesive so that a rubber or plastic sheet may not be caused to adhere to these relatively rigid insulating blocks when laid thereover. This development provides unique means in the nature of a plurality of masonite, plywood, or the like, pads fastened by nailing or screwing to each point of juncture of the corners of four adjacent insulating blocks. The pads will accept adhesive so that a rubber or plastic sheet may be laid thereover and will adhere to the pad's top surfaces of the plurality of blocks. By this unique arrangement, one screw which extends through the deck and through the corners of four insulating blocks will maintain such blocks in proper and desired positions.

1 Claim, 8 Drawing Figures

INSULATION BLOCK AND MOUNTING MEANS THEREFOR

BRIEF SUMMARY OF THE INVENTION

This invention relates to a construction development which is particularly adapted for roofs, or the like, wherein blocks of relatively rigid insulation, such as Styrofoam, are provided. In this discipline where a plurality of abutting blocks of insulation are used, a problem has been encountered with temperature and moisture gaining entrance between adjacent blocks of insulation. It will be apparent to one skilled in this art that the above mentioned problem is serious, undesirable and produces disruptive effects on the structure.

In the roof, or the like, structure of this invention, the blocks of insulation are so configured and are laid in a particular manner so that this problem which has been met in prior structures has been overcome since, due to this particular configuration, adjacent blocks of insulation mate together with other means to be described, to form a sound seal against the entry of moisture or temperature between the blocks.

It is conventional practice in this field to lay a rubber, plastic or the like, sheet over the plurality of laid insulation blocks and to fasten such rubber or plastic sheet to the blocks of insulation. Since Styrofoam and other substances from which the blocks of insulation may be made will not accept an adhesive so that the plastic or rubber sheet will be soundly fastened thereto, I have overcome this problem by providing a plurality of pads of generally rectangular shape which are made of masonite, plywood or the like which will accept an adhesive so that the plastic or rubber sheet will be caused to adhere to the structure including the insulation blocks. This results, in effect, in a spaced apart spot fastening of the rubber or plastic sheet to the entire surface of the entire structure. Each pad is screwed or otherwise fastened to the roof deck and a pad is provided at the point of juncture or intersection of the corners of each four adjacent blocks of insulation. Thus, these pads serve a dual purpose, they accept adhesive and through the screws to which they are fastened to the roof deck, such screws passing through at least the adjacent corners of two of the blocks and then being screwed into the roof deck, maintain the blocks in their desired and proper mated positions.

The roofing structure, which will be discussed in detail hereinafter, comprises two somewhat dissimilarly configured blocks of relatively rigid insulation material and in order to make this description of these blocks crystal clear, I shall term one of these blocks an "UP" block and the other a "DOWN" block. It is to be understood and will become evident as this description proceeds that the "UP" and "DOWN" blocks are laid alternately in a roofing structure. Each of these blocks is of generally rectangular configuration and each includes a rectangular body portion. With respect to the "UP" block a flange extends from three sides of the body portion and a further flange extends from the remaining side thereof, the further flange being less length than the other three flanges to thereby provide cut-outs at two corners of each "UP" block. With respect to the "DOWN" block, flanges of the same length extend from each side of the body portion. As will be explained in detail a specific and highly successful method of laying these "UP" and "DOWN" blocks is practiced. This method of laying a plurality of blocks to form an insulating medium for the roof or other structure results in the aforementioned sealing and mating arrangement between adjacent blocks. Additionally, in practicing this laying method, adjacent blocks are inverted so that one block in a series of blocks is laid with one side thereof up and the next adjacent block is laid with the other side thereof up.

It is also within my contemplation to provide a somewhat modified form of insulation block, each block of which would comprise generally two parts glued or otherwise fastened together in off-set relationship so that adjacent blocks of this construction would also mate together.

A roof structure of this general character may provide the laying of the insulation blocks directly on what I shall term the "roof" or such insulation blocks may be supported on risers, or the like, which rest on the roof which in turn rests on the deck.

It is to be distinctly understood that the mating and hermetic sealing of adjacent blocks for the purposes which will become apparent may be made with a variety of different types of blocks of relatively rigid insulation, for instance, a tongue and groove arrangement as well as triple ship-lap types of blocks and other block types may be used.

Additional objects and advantages of the present invention will become more readily apparent to those skilled in this art when the following general statements and descriptions are read in the light of the appended drawings.

DETAILED DESCRIPTION

Figure 1:
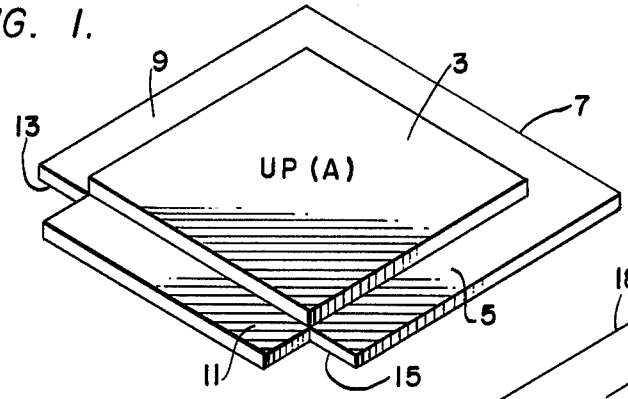
FIG. 1 is a perspective view of an "UP" insulation block.

The two forms of insulation blocks which may be used in this novel and ingenious form of roof structure, or the like, includes a block A which is an "UP" block and a block B which is a "DOWN" block and as will become evident as this description proceeds the A and B blocks are laid alternately in a roofing structure. As I have heretofore stated, these insulation blocks are formed of any suitable type of relatively rigid insulation medium such as Styrofoam.

The block A comprises what I shall term a body portion 3 from three edges or sides of which extend three flanges 5, 7 and 9. From the remaining side of the body portion 3 a flange 11 extends and this flange 11 is of less length than the length of the flange 7, and the flanges 5 and 9 are also of less length than the flange 7, to therefore provide cut-out sections 13 and 15 at linearly oppositely disposed corners of the insulation block A. Consideration of the drawings indicates that the flanges 5 and 9 are dimensionally substantially the same, but are of less length than the flange 7, while the flange 11 is of less length than the flanges 5 and 9. The block B is dimensionally substantially the same as the block A, and the block B also has flanges which extend from all the sides or edges of the body portion 3 and are of all the same length, the cut-outs in the block B being eliminated. The extending flanges of the block B have been designated by the numerals 12, 14, 16 and 18. It is to be understood that all of the flanges on both blocks A and B are formed of insulation material which is preferably the same as that from which the body portion 3 is formed, and may be integrally formed with the body portion.

Figure 2:
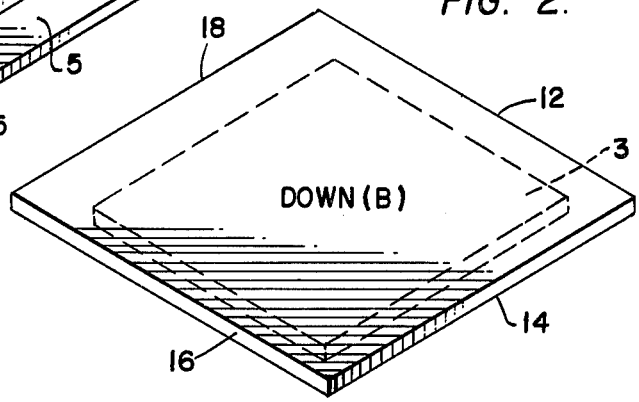
FIG. 2 is a perspective view of a "DOWN" block.

The method of laying a series of insulation blocks A and B in mating abutting sealing position will be described in detail hereinafter. For clarity of description each A block, which is an "UP" block, is formed with the flanges extending from the lower sides or edges of the body portion 3, while the B block, which is the "DOWN" block, is formed with the flanges extending from the upper sides or edges of the body portion 3. The insulation blocks A and B are laid in alternating "UP" and "DOWN" positions, and in FIGS. 1 and 2 of the drawings the insulation block A is illustrated in FIG. 1 in what I term the "UP" position while the insulation block B illustrated in FIG. 2 is shown in reverse or "DOWN" position from the block shown in FIG. 1.

Figure 3:
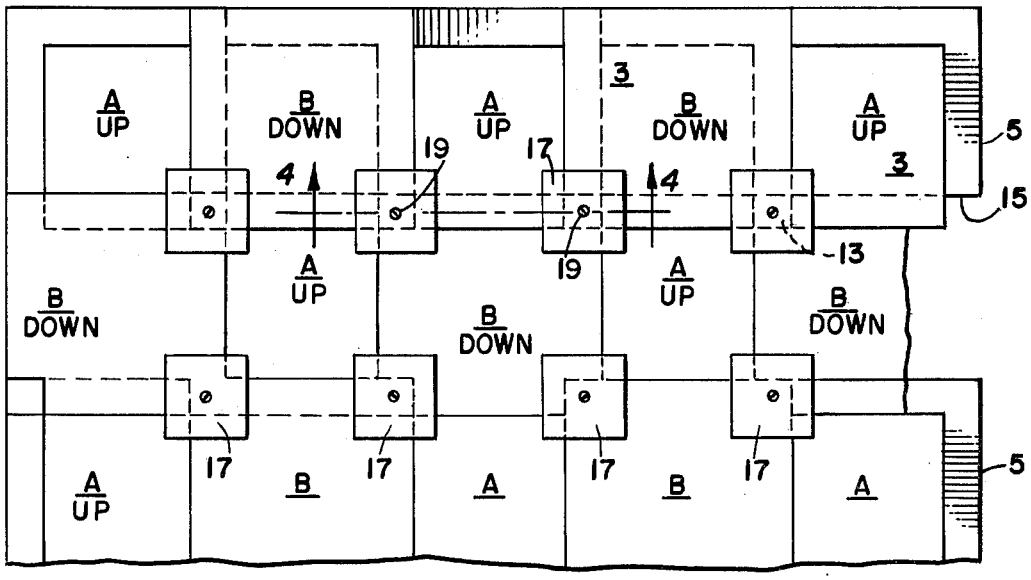
FIG. 3 is a plan view of a series of "UP" and "DOWN" insulation blocks laid in operative insulating position and with the plurality of adhesive accepting pads over-laying adjacent corners of four adjacent insulation blocks.

FIG. 3 illustrates a series of insulation blocks which have been laid in "UP" and "DOWN" alternating positions so that abutting edges of adjacent blocks will mate and seal the entire series of blocks against the entrance of moisture and temperature changes therebetween. It is significant in the laying of the blocks A in proper positions that the cut-out sections 13 and 15 be all facing in the same direction when laid.

The roof structure, or the like, which is illustrated in FIG. 3 of the drawings comprises a plurality of adjacently mating and sealing blocks A and B which are laid in alternate sequences. In this Fig. of the drawings the block A (the left hand block as the drawing is viewed) is laid with the cut-out sections 13 and 15 facing downwardly and the next adjacent block B (which is to the right of the block A as FIG. 3 is viewed) is mated and hermetically sealed to the aforesaid block A in the following manner. With the two blocks in the positions described the flange 18 of the block B will overlay the flange 5 of the block A. Considering again FIG. 3 the next adjacent block B which is downwardly disposed with respect to the aforesaid block A will have its flange 12 overlaying the flange 11 of block A and this arrangement of alternate A and B blocks will be followed throughout the roof structure. It is to be recognized that in the entire series of mating blocks all of the cut-outs 13 and 15 will face in the same direction.

The necessary number of insulation blocks 1 are laid in a manner as outlined above and it will be evident that the cut-out portions at the corners of four adjacent blocks in the series of blocks will permit the blocks to be mated in hermetic sealing juxtaposition. When the blocks have been laid in accordance with the above description and in accordance with the disclosure of FIG. 3, the series of laid blocks is in position to receive thereover a rubber or plastic sheet. As has been mentioned, conventional insulating medium will not accept an adhesive to which the rubber or plastic sheet will be caused to adhere and in overcoming this problem I have devised a novel structure or arrangement not only to which the sheet may be caused to adhere but which also will maintain the insulation blocks in their desired and proper positions. In accomplishing this object, a plurality of masonite, plywood or the like, pads 17 are provided. Each of these pads has a degree of rigidity so that it will function properly in its insulation block holding position. The pads 17 while preferably formed of masonite or plywood may be formed of any suitable relatively rigid material which will accept an adhesive. As will be clear from study of the drawings and particularly FIGS. 3 and 4 thereof, a pad 17 is disposed over adjacent intersecting corners of four adjacent insulation blocks and the pads are dimensionally such that each extends somewhat over a part of each of the four adjacent blocks and it will be appreciated that each pad serves a dual function, it is a repository for adhesive and it also serves to help maintain the four adjacent insulation blocks in proper mating and hermetic sealing position.

Each pad 17 is maintained in proper position by means of a screw or the like 19. Considering FIG. 4 particularly, wherein a "Down" (B) block is disclosed in full and in abutting mating position with the next adjacent side block, each of which is an "UP" (A) block, and it will be seen that the screw 19 on the left hand side of FIG. 4 extends through the pad 17, the flange 18 of the fully illustrated "DOWN" (B) block and the flange 5 of the next adjacent "UP" (A) block, while the screw 19 on the right hand side of FIG. 4 extends through the flange 9 of the fully illustrated "UP" (A) block and the flange 18 of the next adjacent "DOWN" (B) block. A roof deck 21 is provided and any suitable type of water impermeable roof 23 is supported thereon and the insulation blocks rest on the roof. The roof may be of any suitable and desirable type and may consist of a plurality of membranes. Again, considering FIG. 4, it will be evident that each screw 19 extends through the various elements of the insulation blocks as defined above and also extends through the roof 23 and into the deck 21. When the series of blocks have been assembled as pointed out above, any suitable type of adhesive 25 is applied to the exposed surface of each pad 17, whereupon a rubber or plastic sheet 27 or the like, is laid over the entire insulation block structure and the pads, and those portions of the rubber or plastic sheet 27 will adhere to the adhesive which has been applied to each pad so that a spot fastening arrangement is provided. For purposes of illustration, I have shown the pad 17 of somewhat exaggerated thickness. In actual practice the rubber or plastic sheet will extend over the insulation blocks and the pads in substantially the same horizontal plane.

Figure 4:
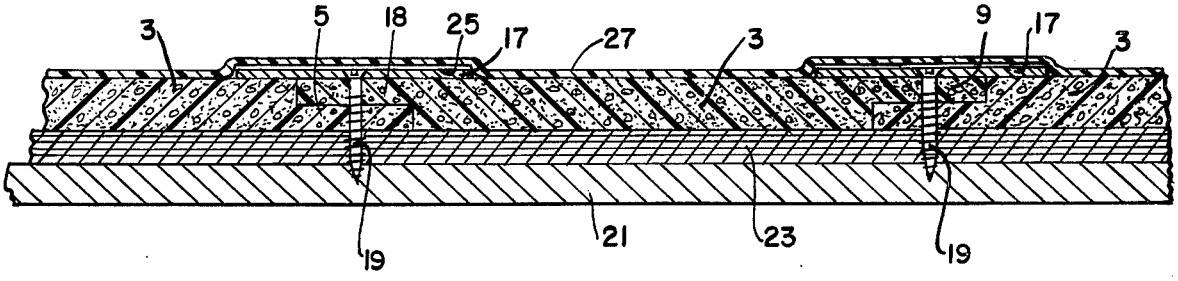
FIG. 4 is a view taken on line 4—4 of FIG. 3.
Figure 5:
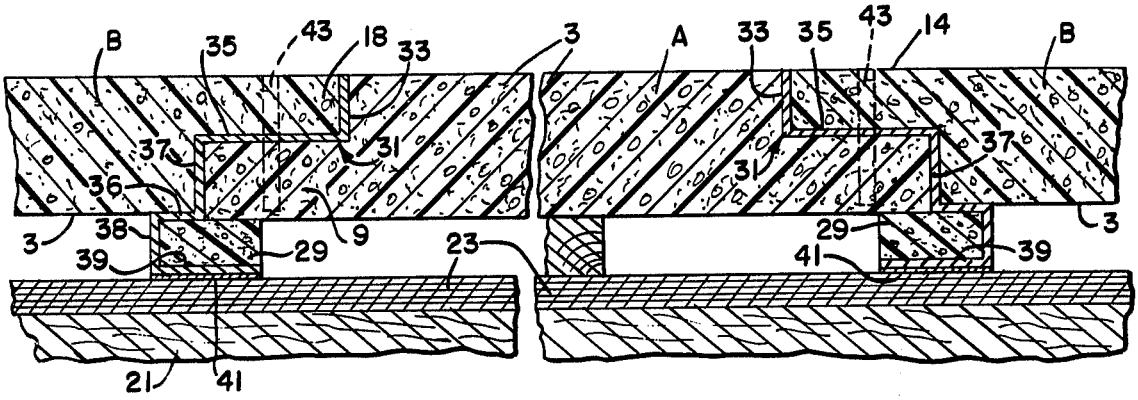
FIG. 5 is a sectional view showing a modified form of roof structure which includes the use of the insulation blocks shown in FIGS. 1 and 2.
Figure 6:
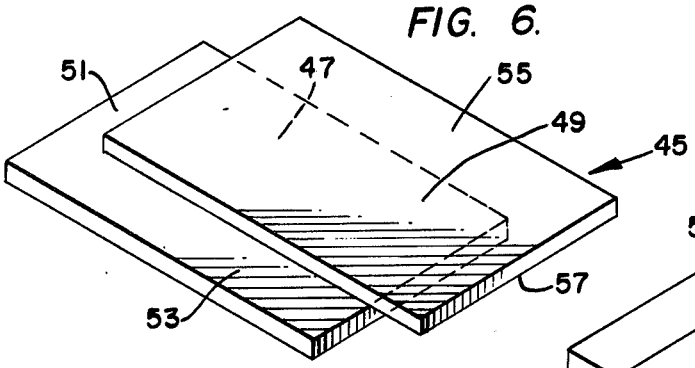
FIG. 6 is a perspective view of a modified form of insulation block.

In FIG. 5 of the drawings, a modified roof structure is illustrated and in the description of this form of the invention the same reference numerals will be used to designate similar parts as have been used in the description of the invention disclosed in FIGS. 1–4. It should be appreciated that the roof structure of FIG. 5 preferably employs the insulation blocks illustrated in FIGS. 1 and 2, although as will become apparent when the insulation block of FIG. 6 is described, this latter block could be used in the roof structure of FIG. 5.

The roof structure disclosed in FIG. 5 includes the roof deck 21, and any suitable roof 23 supported thereon. Supported on the roof 23 and in turn the deck 21 are a plurality of spaced apart riser blocks 29 which may be integral with the insulation block 29 which are mounted and supported on the insulation risers. In this figure of the drawings, the central block is an "UP" (A) block comprising the body portion 3 and the flanges 5, 7, 9 and 11, while the two adjacent "DOWN" (B) blocks comprise the body portion 3 and the flanges 12, 14, 16, and 18. It is to be recognized that the mating and hermetic sealing co-action between adjacent blocks in FIG. 5 is the same as in FIGS. 1–4.

In the adaptation of the roof structure shown in FIG. 5 added strengthening, supporting and sealing means for the series of blocks forming the insulation medium is provided and includes a strap designated generally by the numeral 31 which is disposed between adjacent mating blocks in the following manner. The vertical length 33 of the strap extends between the flange 18 of the "DOWN" (B) block and the body 3 of the "UP" (A) block as viewed on the left-hand side. Extending horizontally from the lower end of the vertical length 33 is a length 35 which extends across the bottom surface of the flange 18 until it abuts the body 3 of the adjacent "DOWN" (B) block. A further length 37 extends downwardly and at right angles from the length 35 and at the lower end of the length 37 a relatively short horizontal length 36 extends with its top surface in abutment with the "DOWN" (B) block and a vertically extending length 38 extends downwardly from length 36 and is in abutment with one side of the riser 29. Horizontally extending length 39 which is substantially the same length as the width of the riser 29 extends under said riser and this horizontally extending riser 39 is glued or otherwise affixed as at 41 to the roof 23. On the right-hand side of FIG. 5, the strap 31 is of the same configuration as is the strap 31 at the left-hand side of FIG. 5, but it will be noted that the vertical length 33 of the strap on the right-hand side extends between the body 3 of the "UP" (A) block and the flange 14 of the "DOWN" (B) block and the horizontal length 35 extends between the flange 14 of the "DOWN" (B) block and the flange 5 of the "UP" (A) block while the length 37 extends between the body 3 of the "DOWN" (B) block and the flange 5 of the "UP" (A) block. Additional strengthening and block maintaining means is provided between all adjacent blocks and the straps by means of a peg 43 which extends through the length 35 of each strap and through the overlaying flange of the "UP" (A) block.

It is to be recognized that the pads 17 of FIGS. 3 and 4 may be used in the same manner as heretofore described on the structure of FIG. 5 so that a plastic or rubber sheet may be laid over the insulation blocks of the structure and caused to adhere thereto.

Figure 7:
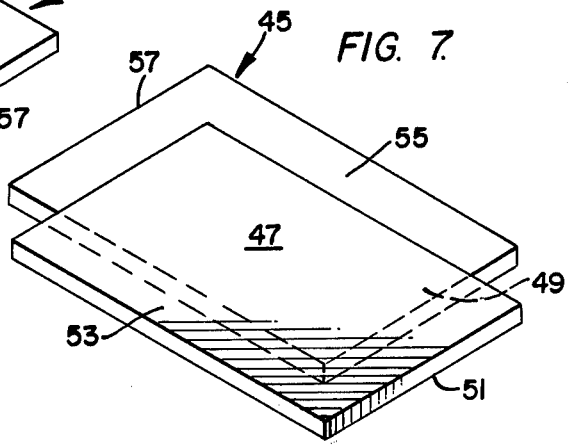
FIG. 7 is a perspective view of the modified form of insulation block illustrating the reverse side of the block illustrated in FIG. 6.
Figure 8:
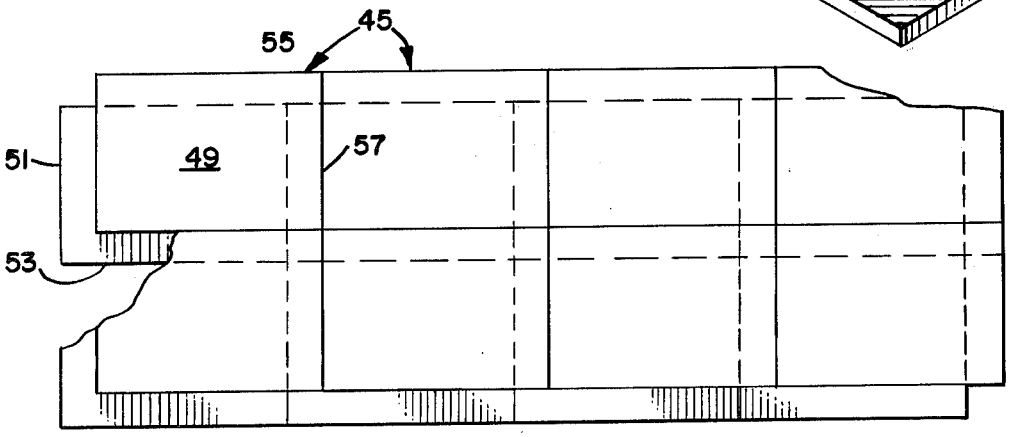
FIG. 8 is a plan view of a series of the modified form of insulation block, the blocks being illustrated in operative mating positions.

In FIGS. 6, 7 and 8 a modified form of insulation block is disclosed and I have designated this form of block by the numeral 45. It will be appreciated that the block 45 of FIG. 6 is turned over or inverted in FIG. 7. The blocks 45 are of ship-lap construction comprising a generally rectangular block 47 upon which a further rectangular block 49 is glued or otherwise fastened to in off-set position so that the block 47 is provided with one extending free edge 51 and another free edge 53 while the block 49 is provided with an extending free edge 55 and another extending free edge 57.

In FIG. 8 of the drawings the blocks 45 are shown laid in a roof, or the like, structure in adjacent block mating hermetic sealing position with the extending free edges of one block lapping over the extending free edges of the next adjacent block, thus, the edge 57 of one block will lap over the edge 51 of the next adjacent horizontally alined block, while the edge 55 will lap over the edge 53 of the next upwardly adjacent block.

It is to be distinctly understood that the pads 17 may be used if desired in this form of construction.

What is claimed is:

1. A structure including a deck, a roof supported thereon and a plurality of rows of relatively rigid insulation blocks laid thereon in abutting position, means provided on certain insulation blocks providing a mating and sealing relationship between abutting insulation blocks and spaced apart pads provided at the adjacent corners of each four adjacent insulation blocks and each of said pads extending partially over a portion of each of the four abutting adjacent insulation blocks, means extending through said pads, the insulation blocks, the roof, and the deck for securing said pads in proper spaced apart position on said insulation blocks, and for securing said insulation blocks to said roof and deck, and said insulation blocks are formed of a material to which adhesive is unacceptable, adhesive being acceptable to said pads, and a flexible sheet means overlaying said insulation blocks and pads and an adhesive applied to each of said pads and said flexible sheet means adhering and bonded to each of said spaced apart pads, said flexible sheet means being bonded to said insulation blocks solely at the spaced apart pads and being free of said insulation blocks in the areas between said pads.

* * * * *